US005366302A

United States Patent [19]

Masumura et al.

[11] Patent Number: 5,366,302

[45] Date of Patent: Nov. 22, 1994

[54] THERMAL PRINTER

[75] Inventors: Yoshinobu Masumura, Amagasaki; Motoki Matsubara, Takaishi; Takayasu Hongo, Kobe; Hisashi Uemura, Nishinomiya, all of Japan

[73] Assignee: Kanzaki Seishi Co., Ltd., Tokyo, Japan

[21] Appl. No.: 143,378

[22] Filed: Oct. 27, 1993

Related U.S. Application Data

[63] Continuation of Ser. No. 916,881, Jul. 20, 1992, abandoned.

[30] Foreign Application Priority Data

Jul. 25, 1991 [JP] Japan ..... 3-066367[U]
Feb. 29, 1992 [JP] Japan ..... 4-079073

[51] Int. Cl.[5] ..... B41J 2/335
[52] U.S. Cl. ..... 400/120.16; 346/76 PH
[58] Field of Search ..... 400/120, 120 HE; 346/76 PH

[56] References Cited

U.S. PATENT DOCUMENTS 4,962,392 10/1990 Okuno et al. ..... 400/120 HE
5,005,020 4/1991 Sakai ..... 400/120 HE

FOREIGN PATENT DOCUMENTS 11168 8/1985 Japan ..... 400/120 HE
0225775 11/1985 Japan ..... 400/120
0012381 1/1986 Japan ..... 400/120 HE
0063457 4/1986 Japan ..... 400/120 HE
0125871 6/1986 Japan ..... 400/120 HE
0266262 11/1986 Japan ..... 400/120 HE
0134274 6/1988 Japan ..... 400/120 HE
0020023 10/1991 Japan ..... 400/120
0230988 10/1991 Japan ..... 400/120

*Primary Examiner*—Edgar S. Burr
*Assistant Examiner*—John S. Hilten
*Attorney, Agent, or Firm*—Schweitzer Cornman & Gross

[57] ABSTRACT

A thermal printer comprising a platen roller, a head mounting bracket having a thermal head attached thereto, a head holder for removably containing the head mounting bracket at a predetermined stationary position relative to the platen roller, and a pivotable support assembly pivotable about a supporting shaft, the pivotal support assembly housing the thermal head, head holder, and the head mounting bracket for pivotal movement of the thermal head, head holder, and the head mounting bracket toward and away from the platen roller, the head holder being a boxlike supporting frame having an opening at its bottom for fitting the head mounting bracket therethrough, the head mounting bracket and the supporting frame having respective front portions opposite to one another and being provided with engaging means for locating the head mounting bracket in the head holder at a predetermined fixed lateral position, the head mounting bracket and the supporting frame having respective rear portions with engaging means opposite to one another for locating the head mounting bracket in the head holder at a predetermined fixed front to rear position.

6 Claims, 4 Drawing Sheets

THERMAL PRINTER

This is a continuing application of U.S. Ser. No. 916,881, filed on Jul. 20, 1992, now abandoned.

FIELD OF THE INVENTION

The present invention relates to a thermal printer and an arrangement for replacement for the thermal head which requires frequent replacement after relatively short periods of use.

BACKGROUND OF THE INVENTION

In conventional thermal printers, the main frame of the printer is provided with a head mounting space for mounting a thermal head, which is fastened in the head mounting space with mounting screws. The replacement for the thermal head requires a hand tool, e.g. a screwdriver, to loosen and retighten the mounting screws.

When the thermal head is secured to the main frame of the printer, locating of the thermal head relative to the main frame of the printer requires adjustment sometimes when the mounting screws are only temporarily tightened. More particularly, the mounting screws are usually repeatedly incompletely tightened for temporarily positioning the thermal head and are then finally tightened after the correct position of the head on the printer is determined by trial printing.

Such a conventional procedure of replacement of the thermal head is cumbersome, time consuming, and requires specialized skills.

SUMMARY OF THE INVENTION

A first objective of the present invention is to overcome the problems of the prior-art, by providing an improved method and apparatus for the replacement of a thermal head on the main frame of a thermal printer without the use of hand tools and mounting screws.

The thermal head is required to be mounted so accurately that a matrix of heating elements in the bottom thereof comes into moderate contact with the surface of a platen roller, and that the printing line is disposed parallel to the axis of the platen roller. For satisfying this above requirement, the accurate mounting of the thermal head onto the printer frame is determined by means for its accurate positioning in right-left, forward-backward, and upward-downward directions.

In the prior art, the positioning of the thermal head is performed through adjustment by the loosening and tightening of the mounting screws.

It is another second objective of the present invention to provide the means for positioning the thermal head on the printer frame for its accurate installation relative to the platen roller without the use of mounting screws.

For the achievement of these and other objectives, the thermal printer of the present invention comprises a head mounting bracket carrying a thermal head, a head holder for detachably holding the head mounting bracket therein, and a pivotable head support assembly for supporting the head holder containing the head mounting bracket at a stationary position relative to a platen roller, and for pivotal movement for turning it away from the platen roller.

As the head mounting bracket carrying the thermal head is detachably installed in the head holder which is in turn supported by the head pivotal support assembly, replacement of the thermal head can be carried out by dismounting and remounting of the head mounting bracket onto the head holder without fastening it directly in the main frame of the printer by means of mounting screws.

Also, the thermal head is supported by the head pivotal support assembly at a stationary position opposite to the platen roller, and its position relative to the platen roller can be determined by pivoting of the head support assembly without the need of cumbersome adjustment.

BRIEF DESCRIPTION OF THE DRAWING

The novel features of the invention are set forth particularly in the appended claims, the invention is explained in greater detail in the following detailed description with reference being had to the drawing, wherein:

DETAILED DESCRIPTION OF PREFERRED EMBODIMENTS

Figure 1:
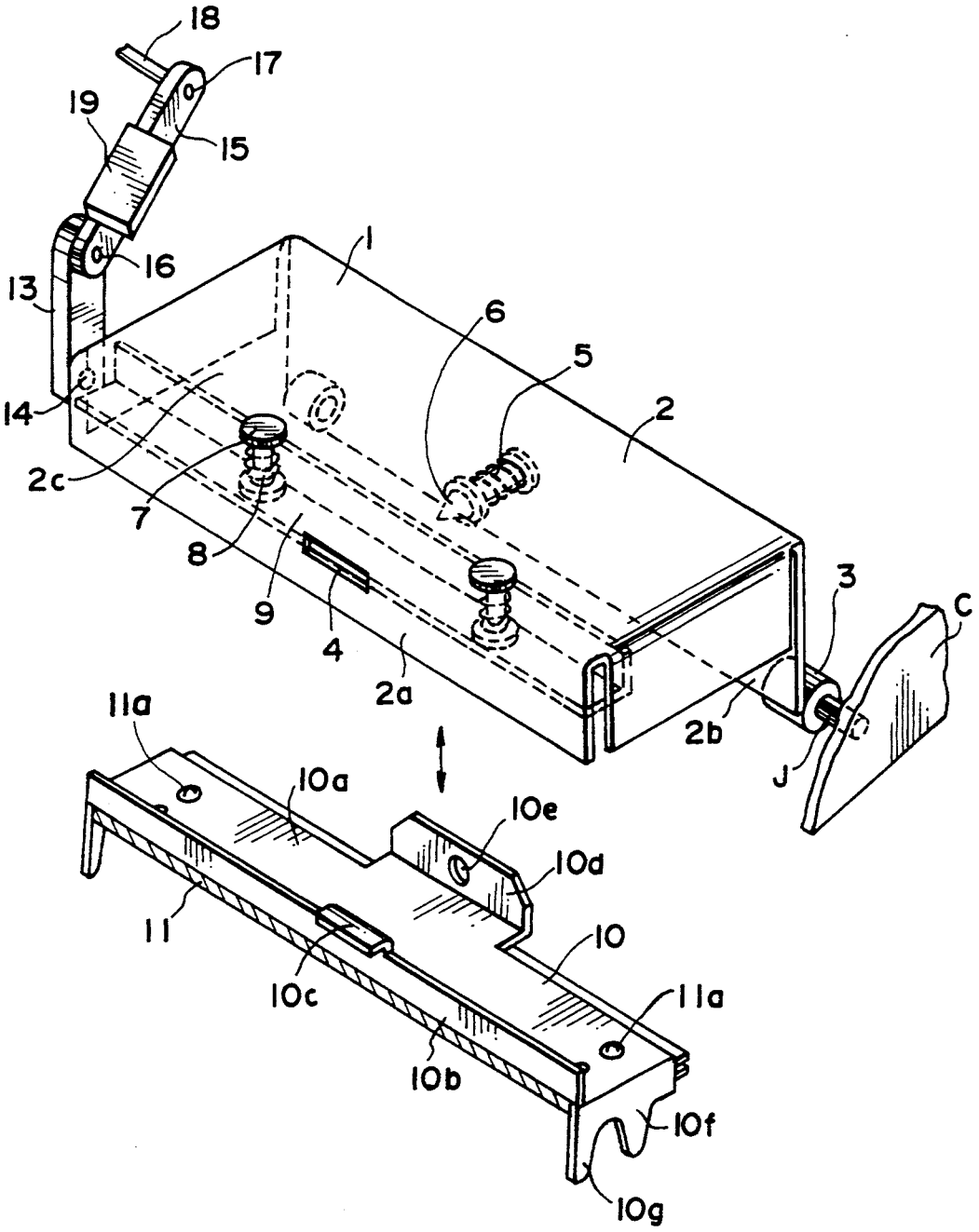
FIG. 1 is an exploded perspective view of a first embodiment of the present invention, showing a head mounting bracket separated from a head pivotal support assembly formed integral with a head holder.

In FIG. 1, a pivotable support assembly 1 has a support body and head holder 2 and supporting pivots 3. The support body 2 is formed as a box shape having an opening at the bottom for serving as a head holder. In the arrangement of the first embodiment of the present invention, the head holder 2 is formed integrally with the head pivotal support assembly 1.

Figure 2:
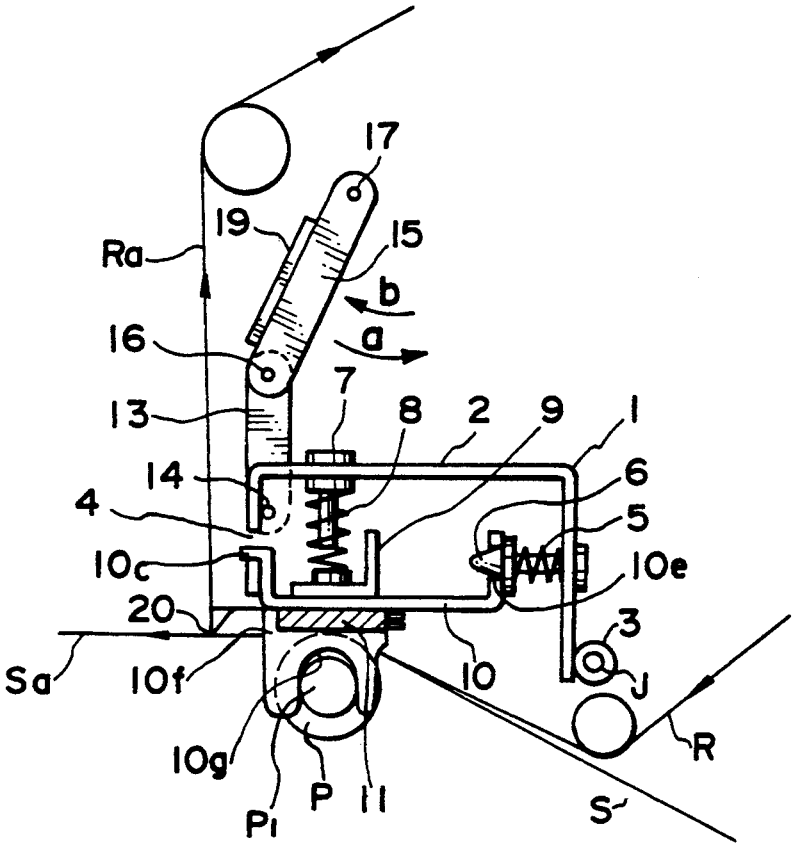
FIG. 2 is a side view of the embodiment of FIG. 1, in which the head mounting bracket is installed in the head holder of the head pivotal support assembly.

Each supporting pivot 3 of the pivotable support assembly 1 has a shaft J fitted loosely into it. The shaft J is attached to a printer frame C, and, as shown in FIG. 2, extends parallel to a shaft $p_1$ of a platen roller p. The pivotable support assembly 1 can pivot about the shaft J.

As shown in FIGS. 1 and 2, the head holder 2 has a horizontally extending slot 4 in the front panel 2*a* thereof and a spring loaded pressure pin 6 mounted in its rear panel 2*b*. The spring loaded pressure pin 6 is slidably mounted within the rear panel 2*b* of the head holder and is biased forward by a spring 5. Also, a pair of pressure pins 7 are downwardly slidably mounted within the top panel 2*c* of the head holder 2. Each pressure pin 7 is biased upward by a spring 8 pressing against a laterally extending hold-down plate 9 having an upwardly extending portion of which longitudinal direction is equal to tile axial direction of the platen roller P. The pressure pins 7 are secured by double nuts to the top panel 2*c* of the head holder 2 for upward and downward sliding movement therein, against the bias of tile springs 8. The springs 8 are positioned directly above the platen roller P, as shown in FIG. 2.

A head mounting bracket 10 is accommodated in the head holder 2 and has a thermal head 11 attached to a lower surface of a main portion 10*a* thereof by two head mounting screws 11*a*. The front edge of the main portion 10*a* of the head mount 10 is folded upwardly, forming a contact side 10*b*. An upper center portion of the contact side 10*b* of the head mount 10 is folded outwardly forming an engaging tab 10*c* for insertion into the horizontal slot 4 in the head holder 2. A central portion of the rear edge of the main portion 10*a* of the head mount 10 is folded upwardly, forming a rear vertical projecting portion 10*d*. The projecting portion 10*d* has a central engaging hole 10*e* for engagement with the spring loaded pressure pin 6. As the thermal head 11 is attached to form an integral whole with the main portion 10*a* of the head mount 10, the head mount 10 has to be removed from the head holder 2 for replacement of the thermal head 11.

Both ends of the main portion 10*a* of the head mount 10 have downward folded portions forming end plates 10*f*, each having a U-shaped notch 10*g* therein. The end plates 10*f* can thus accept therein the shaft $P_1$ of the platen roller P, at the notches 10*g*, as shown in FIG. 2.

As best shown in FIG. 1, the pivotable support assembly 1 is connected at one end near the front panel 2*a* to a linking member 13 through a pin 14 so that the linking member can pivot about the pin. In turn, the linking member 13 is pivotably coupled at its other end by a fixed pin 16 to a lever 15 having an operating plate 19 mounted thereon. A shaft hole 17 is provided at the other end of the lever 15. A shaft 18 is rotatably fitted within the shaft hole 17 for rotating the lever 15. The shaft 18 carries a cam (not shown) to maintain the pivotable support assembly 1 at a stationary point so that the thermal head 11 is brought into contact with the platen roller at a desired pressure.

The procedure of mounting the head mounting bracket 10 onto the head holder 2 is explained by reference to FIG. 2. When the lever 15 provided with the operating plate 19 thereon is turned counterclockwise as denoted by the arrow a, the pivotable support assembly 1 is tilted upwardly about the shaft J. Thus the head holder 2 is raised and its lower opening becomes accessible. Then, the head mounting bracket 10 is inserted through the lower opening into the head holder 2. The head mount 10 is attached to the head holder 2 as its engaging hole 10*e* accepts the pressure pin 6 and its engaging tab 10*c* fits into the slot 4. When the lever 15 and the operating plate 19 are turned by the a clockwise action of the cam (not shown) on the shaft 18, as denoted by the arrow b in FIG. 2, the pivotable support assembly 1 turns downwardly to the stationary position, shown in FIG. 2. At his position, the thermal head 11 is biased by the springs 8 against the platen roller P. The notches 10*g* of the head mounting bracket 10 engage the shaft $P_1$ of the platen roller P thus to prohibit forward and backward movement of the head mount 10. Thus the thermal head 11 can be maintained by moderate pressure in contact with the platen roller P.

The engagement of the central engaging hole 10*e* with the pressure pin 6 can be facilitated by pushing the pressure pin 6 backwardly through an extra opening (not shown) in the top panel 2*c* of the head holder 2, or by allowing the rear vertical projecting portion 10*d* to urge the front end of the moderately tapered, pressure pin 6, backwardly by an upward lifting movement.

A ribbon separator bar 20 is provided in front of the platen roller P, which has a substantially triangular cross section and extends parallel to the shaft $P_1$ of the platen roller P. The ribbon separator bar 20 can be mounted either onto the head mounting bracket 10 or the printer frame C.

In operation, an inked printing ribbon R and a sheet of paper S are fed forwardly between the thermal head 11 and the platen roller p while the head mounting bracket 10 remains stationary. Printing ink from the ribbon R is melted by the thermal head 11 and transferred to form indicia on the paper S. Thereafter, the ribbon R and the paper S are separated from each other by the ribbon separator bar 20 into an exiting ribbon portion Ra and an exiting paper portion Sa, respectively.

Figure 3:
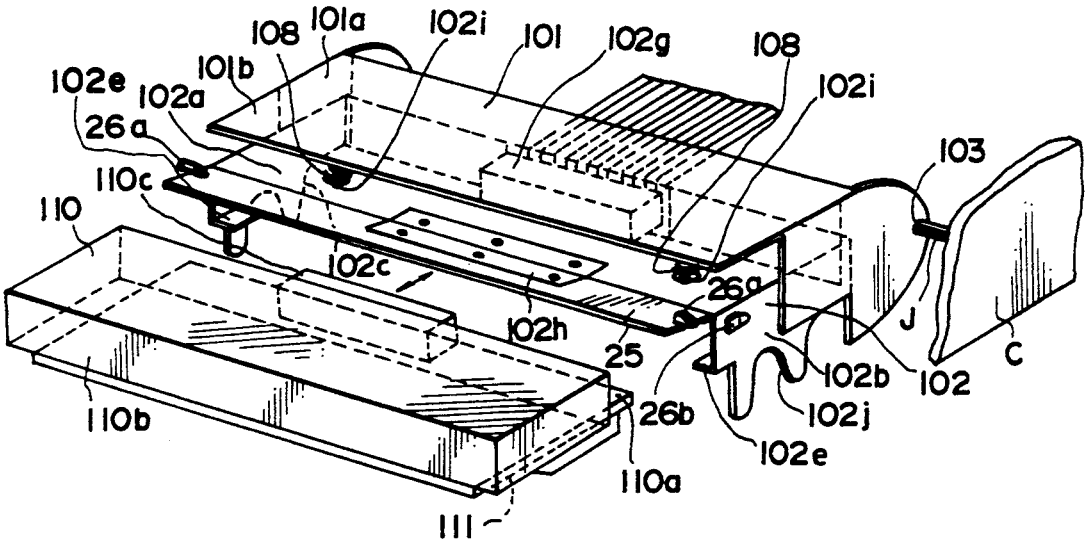
FIG. 3 is an exploded perspective view of a second embodiment of the present invention, showing a head mounting bracket separated from a head pivotal support assembly having a separate head holder.
Figure 4:
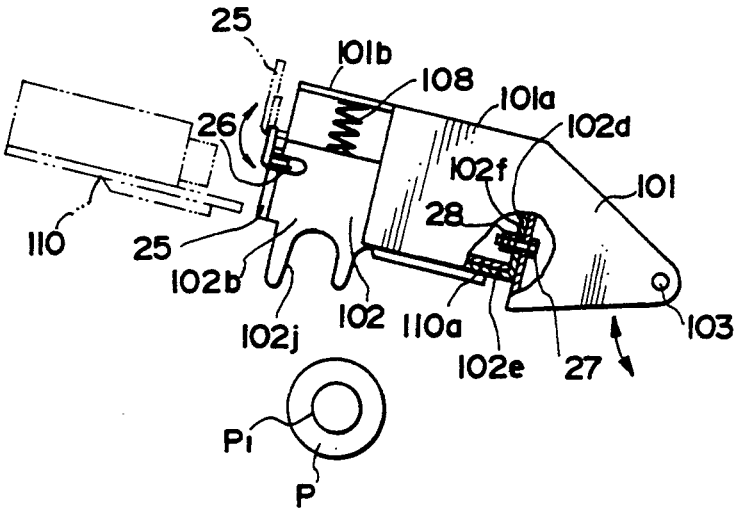
FIG. 4 is an explanatory view showing the installation into the head mount in the second embodiment.
Figure 5:
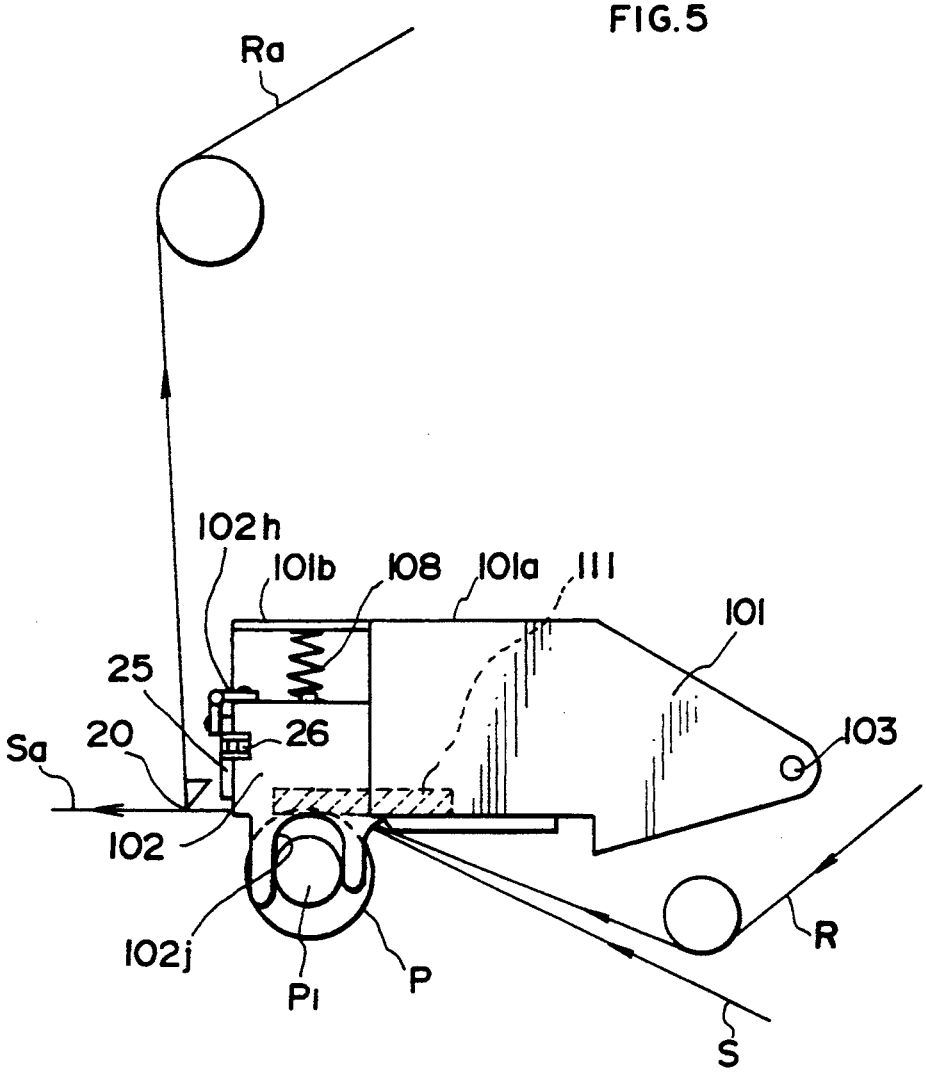
FIG. 5 is a side view of the embodiment of FIG. 3 in which the head mounting bracket is installed in the head holder that is separate from the head pivotal support assembly.

FIGS. 3–5 show a second embodiment of the present invention, in which a head mounting bracket 110 comprises a lower plate 110*a* having a thermal head attached to it containing a matrix of heating elements and a printed circuit board containing a drive circuit. The head mounting bracket has a rectangular head cover 110*b*, and a connector 110*c* mounted onto the rear of the head cover 110*b*. The lower plate 110*a* is smaller in width than the head cover 110*b*.

A head holder 102 is provided for accommodating the head mounting bracket 110 therein and is formed as a flat box having a top panel 102*a*, a left end panel 102*b*, a right end panel 102*c*, and a rear panel 102*d*. The front and the bottom of the head holder 102 remain open. Lower ends of the left and right ends panels 102*b*, 102*c* are folded inwardly, thus forming two tabs 102*e* for holding the head mounting bracket 110 that is inserted from the front of the head holder 102 so that the thermal head 111 with is heating elements is exposed from the bottom.

The rear panel 102*d* of the head holder 102 has mounting holes 102*f* therein through which screws 27 are tightened for securing the head holder 102 to a main frame 101*a* of a pivotable support assembly 101, as shown in FIG. 4. Also, the rear panel 102*d* has an interior receptor 102*g* for coupling with the connector 110*c* of the head mounting bracket 110. The head holder 102 has a door flap 25 joined by a hinge 102*h* to the front panel thereof for covering the front opening. As shown in FIG. 3, the top panel 102*a* has two stops 102*i*, one each for holding a respective spring 108. The other ends of the springs 108 are mounted onto the top panel 101*b* of the main support frame 101*a*. The upper ends of each spring 108 are coupled to the lower surface of the top panel 101*b*, and each spring has a lower end coupled to the stops 102*i* which are projected so such that the lateral movement of the springs 108 is prevented. The springs 108 are disposed right above the platen roller P, as shown in FIG. 5.

Figure 6:
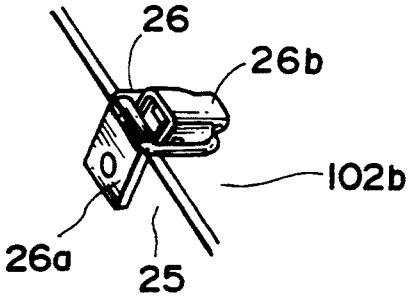
FIG. 6 is a perspective view of a component employed in the embodiment of FIG. 3.

As shown in FIG. 6, a latchhook 26*a* of a lock 26, such as a hook fastener, is attached to and at the left and right ends 102*b*, 102*c* of the head holder 102. Both the left and right ends 102*b*, 102*c* have U-shaped notches 102*j* at the downward extension.

The pivotable support assembly 101 is pivotably mounted by a shaft J onto the printer frame C so that it can turn upwardly and downwardly about the shaft J as shown by the double headed arrow in FIG. 4.

The head holder 102 is mounted in the following manner onto the main supporting frame 101*a* of the pivotable support assembly 101. The screws 27 are inserted from the rear of the pivotable support assembly 101 into the mounting holes 102*f* in the rear panel 102*d* of the head holder 102, and then the screws 27 are fastened with double nuts 28 for providing a slight degree of looseness. The aforesaid mounting holes 102*f* extend vertically at two position to the right and the left sides of the rear panel 102*d*. Accordingly, a screw 27 each is inserted into the right and left mounting holes 102*f*.

The head holder 102 is movable upwardly and downwardly along the vertically extending mounting hole 102*f* in relation to the main support frame support frame 101*a* of the pivotable support assembly 101. As the springs 108 downwardly press the top panel 102*a* of the head holder 102, their biasing force is exerted onto the head mounting bracket 110. The thermal head 111 of the head mounting bracket 110 is thus urged against the platen roller P, as shown in FIG. 5.

When installing the head mounting bracket 110 into the head holder 102, the pivotable support assembly 101 is tilted upward about the shaft J, as shown in FIG. 4, to lift the head holder 102 away from the platen roller P. Then, the flap 25 is tilted and the head mounting bracket 110 with the thermal head 111 attached thereto is inserted into the head holder 102. The connector 110*c* of the head mounting bracket 110 is accepted into the interior receptor 102*g*. After the flap 25 is closed, a latchhook 26*a* of each lock 26 on the flap 25 is locked with the hook locker 26*b* so that the flap 25 is fastened onto the head holder 102.

The precise lateral positions of the head mounting bracket 110 is determined upon its installation by the inner surfaces of the left and right panels 102*b*, 102*c*. Also, the front and rear position of the head mounting bracket 110 is determined by the flap 25 holding front head cover p 110*b* of the head mounting bracket 110 and the rear panel 102*d* of the head holder 102 restricting the rearward movement of the lower plate 110*a*. The head mounting bracket 110 is also pressed downwardly against the holding tabs 102*e* of the head holder 102 by the pressure of the springs 108 between the main support frame 101*a* of the pivotable support assembly 101, and the top panel 102*a* of the head holder 102. Accordingly, the vertical position of the head mounting bracket 110 in the head holder 102 is determined by the springs 108 and the holding tabs 102*e*. Thus the head mount 110 is securely held by the head holder 102 without any play. The pressure of the springs 108 also slightly urges the thermal head 111 against the platen roller P.

After installation of the head mounting bracket 110 into the head holder 102, the pivotable support assembly 101 is turned down about the shaft J. The notches 102*j* in the left and right ends 102*b*, 102*c* of the head holder 102 engage the shaft $P_1$ of the platen roller P. This determines the printing position of the thermal head 111 against the platen roller P across the feeding direction.

As shown in FIG. 5, a ribbon separator bar 20 is provided in front of the platen roller P, with a substantially triangular cross section and is parallel to the shaft $P_1$ of the platen roller P. The ribbon dispenser 20 can be mounted onto either the head mounting bracket 110 or the printer frame C.

In operation, when an inked ribbon R and paper sheet S are fed forward between the platen roller P and the thermal head 111 under the installed head mounting bracket 110, the printing ink in the ribbon R is melted by the thermal head 111, and is in part transferred by printing indicia onto the paper S. Thereafter, the ribbon R and the paper S are separated by the ribbon separator bar 20 into the exiting ribbon portion Ra and the exiting paper portion Sa respectively.

The present invention has been described in terms of preferred embodiments, it is to be understood that the scope of the present invention is to be determined from the claims appended hereto.

We claim:

1. A thermal printer comprising a platen roller, a head mounting bracket having front and rear portions, said head mounting bracket having a thermal head attached thereto, a head holder for removably containing the head mounting bracket at a predetermined stationary position relative to the platen roller, said head holder including a pivotable support assembly pivotable about a supporting shaft, said pivotal support assembly housing said thermal head, head holder, and said head mounting bracket for pivotal movement of said thermal head, head holder, and said head mounting bracket toward and away from the platen roller, said head holder being a boxlike supporting frame having an opening at its bottom for fitting said head mounting bracket therethrough, said head mounting bracket and said supporting frame having respective front portions opposite to one another and being provided with an engaging tab on the front portion of said head mounting bracket for locating the head mounting bracket in said head holder at a predetermined fixed lateral position, said head mounting bracket and said supporting frame are disposed opposite to each other and have respective rear portions with second engaging means for locating the head mounting bracket in said head holder at a predetermined fixed front to rear position, said head mounting bracket and said supporting frame having respective top portions opposite to one another, pressure means located between said respective top portions for positioning in association with said engaging tab and said second engaging means said head mounting bracket in said head holder at a predetermined fixed vertical position, said pressure means having a hold down plate disposed below the top portion of the supporting frame, and a spring disposed between said hold down plate and the top portion of said supporting frame, a horizontally extending slot opposite to said boxlike supporting frame for engagement with said engaging tab, said second engaging means having an engaging hole on the rear portion of said head mounting bracket, and a spring loaded pressure pin on the rear of said boxlike supporting frame for engagement with said engaging hole.

2. A thermal printer comprising a platen roller, a head mounting bracket having a thermal head attached to said head mounting bracket, a head holder for removably containing the head mounting bracket at a predetermined stationary position relative to the platen roller, and a pivotable support assembly housing said holder for pivotal movement of said thermal head toward and away from said platen roller, said head holder having a boxlike shape with a front panel having an opening therein for fitting said head mounting bracket therethrough, a pivotable flap for closing the opening in said front panel, a lock for selectively maintaining the flap closed, said head mounting bracket within said head holder of boxlike shape, having an opening at the bottom thereof for enabling the thermal head to contact the platen roller, and a flange each at each end of said head mounting bracket.

3. The thermal printer of claim 2, further comprising a spring, said head holder being vertically loosely disposed within said pivotable support assembly, said spring pressing said head holder downwardly within said assembly.

4. The thermal printer of claim 2, wherein said head mounting bracket is firmly mounted in the head holder.

5. The thermal printer of claim 2, wherein said head holder further comprises a connector for establishing an electrical connection between said head mounting bracket and an exterior source of electric power.

6. The thermal printer of claim 2, wherein said platen roller comprises a supporting shaft and wherein said head holder further comprises fitting means for engagement with said supporting shaft.

* * * * *